US005184598A

United States Patent [19]

Bell

[11] Patent Number: 5,184,598

[45] Date of Patent: Feb. 9, 1993

[54] SAW CHAIN FOR AGGREGATE MATERIALS

[75] Inventor: Don A. Bell, Portland, Oreg.

[73] Assignee: Blount, Inc., Portland, Oreg.

[21] Appl. No.: 730,192

[22] Filed: Jul. 15, 1991

[51] Int. Cl.[5] ..... B28D 1/08

[52] U.S. Cl. ..... 125/21; 51/136

[58] Field of Search ..... 125/16.02, 21, 22, 18; 51/136; 83/830, 831, 832, 833, 834; 30/381

[56] References Cited

U.S. PATENT DOCUMENTS

| | | | |
|---|---|---|---|
| 2,869,534 | 1/1959 | Stihl | 125/21 |
| 3,180,378 | 4/1965 | Carlton | 83/834 |
| 3,593,700 | 7/1971 | McNulty | 125/21 |
| 4,269,100 | 5/1981 | Deelman et al. | 83/834 |
| 4,920,947 | 5/1990 | Scott et al. | 125/22 |
| 4,971,022 | 11/1990 | Scott et al. | 125/22 |

FOREIGN PATENT DOCUMENTS

| | | | |
|---|---|---|---|
| 0206343 | 11/1959 | Austria | 125/22 |

*Primary Examiner*—Robert A. Rose
*Attorney, Agent, or Firm*—Robert L. Harrington

[57] ABSTRACT

An articulated saw chain for cutting aggregate material and the like. The saw chain has cutting blocks affixed to pairs of side links and guards formed or attached to side link pairs positioned between successive cutting blocks. A guard portion is thus adjacent each end of the cutting block. The guard portions extend to substantially the same height as the cutting block to protect the edge of the cutting block from impacting against an object. The guards wear at a rate that does not significantly impede or interface with the cutting action of the cutting block.

8 Claims, 3 Drawing Sheets

SAW CHAIN FOR AGGREGATE MATERIALS

BACKGROUND OF THE INVENTION

1. Field of the Invention

This invention relates to a cutting chain (saw chain) for cutting aggregate materials and more particularly to a cutting chain having guard links with guard portions that precede the cutting links and permit efficient cutting while protecting the leading edge of the cutting links.

2. Background Information

Cutting chains are commonly used to cut trees and logs and more recently have been successfully applied to the cutting of aggregate materials such as masonry, stone and the like. However, there is a very significant difference in the cutting technique that is applied to cutting wood as compared to aggregate. For wood, the cutting link of the cutting chain includes a forwardly projected cutting edge. This cutting edge is designed to penetrate into the wood material and develops a kerf by repeatedly gouging out particles of wood. For aggregate, the cutting link of the cutting chain includes a diamond impregnated flat face (the upper surface of a cutting block provided on the link) that rubs against the aggregate and develops a kerf by abrading away the aggregate.

For a wood cutting chain, it is not only desirable but essential that the leading edge of the cutting link be exposed and engage the wood being cut. The corresponding "face" of the wood cutting chain is relieved to avoid rubbing contact. For an aggregate cutting chain, it is desirable to provide a surface-to-surface rubbing contact (cutting block surface to aggregate kerf bottom). Exposing the leading edge of the cutting block serves no useful purpose and conversely should the leading edge impact a hard object imbedded in the aggregate, e.g. reinforcing rods or rebar, in concrete, the edge can become chipped. In a short time, the cutting efficiency will be undesirably reduced. Avoidance of such edge impact is desirable.

Providing guard portions on guard links of cutting chain are not uncommon for cutting chains used for cutting wood. However, they are used for protecting the depth gauge of the cutting link and not the cutter. Furthermore, the guard portion and the depth gauge are intentionally set below the peak (i.e., the cutting edge) of the cutter by a significant amount. The depth gauge is set, e.g. to a depth of 0.030 inch below the cutting edge and has to be periodically filed to maintain sufficient exposure of the cutting edge of the cutter. The guard portion is set below the depth gauge by an extent to provide sufficient exposure that will not interfere with the cutting operation throughout the life of the cutter. The concept of the depth gauge and/or guard portion as applied to wood cutting chain is not applicable to aggregate cutting chain where the material is abraded.

U.S. Pat. No. 4,920,947 directed to aggregate cutting chains provides side links preceding the cutting blocks with depth gauge portions on the side links that extend to the height of the cutting blocks and presumably protect the leading edge of the cutting block. However, the depth gauge portion that has been used is a hard steel that interferes with the cutting action of the cutting block. The hardness is necessary to achieve adequate wearability of the side links, i.e. the material surrounding the rivet holes and along the bottom edge that slides on the guide bar wears rapidly and a softer material would have inadequate life. Thus, if the hardness of the depth gauge of the '947 patent is maintained, the cutting action must be repeatedly stopped and the guard portions filed down below the cutting block height. A tedious procedure and one that is not acceptable.

BRIEF SUMMARY OF THE INVENTION

Accordingly, the present invention has as an object the provision of a side link that resists wear at the bearing surfaces but has a guard portion that will readily wear away when brought into contact with the aggregate during the cutting operation. The guard portion extends substantially to the height of the cutting block but the guard has a rate of wear that is at least as great and preferably greater than the rate of wear of the cutting block. The pressure applied to achieve abrading of the aggregate by the cutting block is thus sufficient to achieve wearing of the guard portion without interference with the cutting operation. Yet the leading edge of the cutting block is protected against undesirable impact.

As will be explained in detail, there are two embodiments presently contemplated to achieve this objective. In one, a depth gauge portion is provided from a different and softer material than the body portion of the guard link. This softer material may be a plastic insert that is secured to the body portion. It may also be provided in a discriminate annealing process that softens the guard portion of the side link that is otherwise integral with the body portion. In the second and preferred embodiment, the side link is provided with guard portions that are narrowed to points. Throughout the usable depth of the cutting block, only a small surface area of the guard material is exposed to the aggregate, e.g. forms a spear-like point that projects substantially to the cutting block height. The hardened steel of the side link is substantially softer than the diamond impregnated cutting block and the narrow landing area of the guard portion in contact with the aggregate readily wears due to contact with the aggregate as compared to the abrading face of the cutting block.

Reference is now made to the detailed description and the attached drawings.

DESCRIPTION OF THE PREFERRED EMBODIMENT

The cutting of aggregate materials and the like by chain saws requires that extreme pressures (forces) be applied to the cutting blocks to abrade the material away. The pressure applied during a cut is of course distributed over the cross sectional area of the cutting block which provides a uniform distribution of the cutting force. The cutting force is applied by the bar of the chain saw forcing the chain into the cut. The side links of the chain as they traverse the bar are riding on the rails of the bar and the force applied by the bar is thus uniformly applied to the cutting blocks via the side links. Although the cutting blocks, which are often industrial diamonds imbedded in a matrix, will withstand the distributed operating pressures, they are vulnerable to shock loads such as having an edge of the cutting blocks impacted against an edge of an object such as rebar imbedded in the aggregate material. An impact against an edge of the cutting block produces a localized high stress inducing force which the cutting block is frequently unable to withstand. The cutting blocks are likely to be impacted at the leading edge (end). Since the chain is reversibly driven on the guide bar, both edges (ends) of the cutting block need to be protected.

The bearing surfaces of the saw chain components must be of very hard wear resistant material to withstand the large forces and abrasive conditions experienced when cutting aggregate material and the like. The material is reduced to fine abrasive particles as the cutting block abrades the material away to produce a cut (saw kerf). The bearing surfaces of the chain such as the pivotal interconnections and the side links of the chain riding in frictional contact on the rails of the guide bar are subjected to the concrete dust which aggravates the wear problem and heightens the need for the wear resistant materials.

Figure 1:
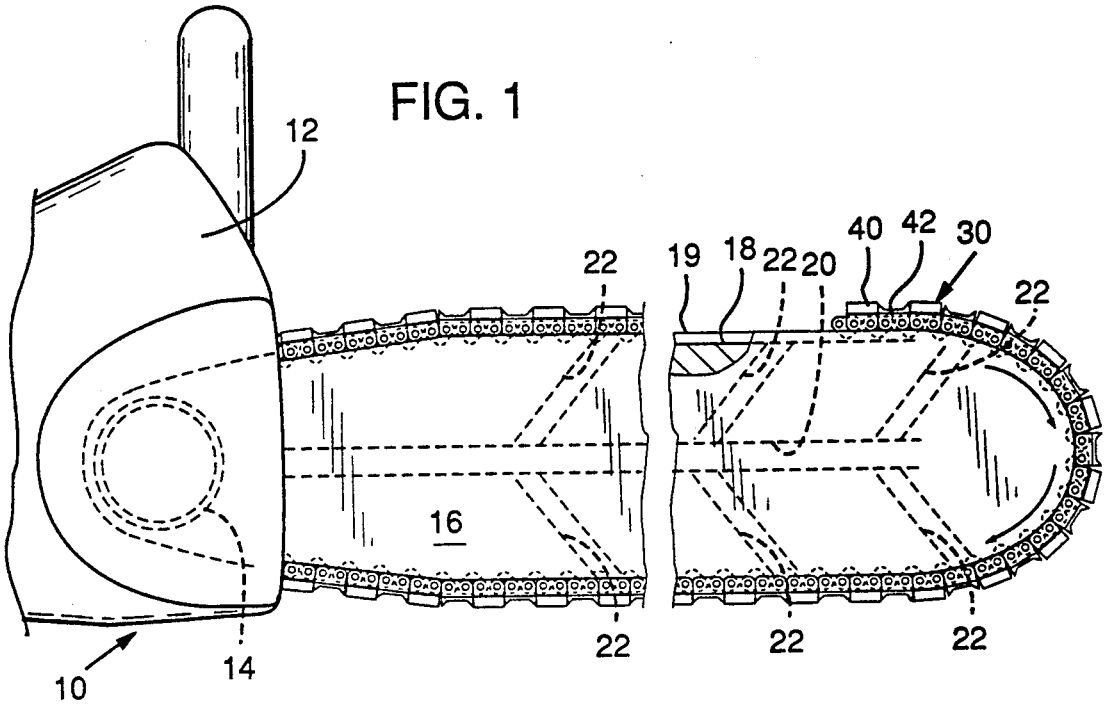
FIG. 1 is a view of a chain saw for cutting aggregate material.

Refer now to FIG. 1 of the drawings which illustrates a chain saw 10 for cutting aggregate material. The chain saw has a power head 12 with a drive sprocket 14 that is drivable in either direction of rotation. A guide bar 16 for guiding and supporting a saw chain 30 is fitted to the power head 12 in relation to the drive sprocket 14. The guide bar 16 is of symmetrical construction and may be reversibly mounted on the power head 12 in conventional manner. The guide bar 16 has a groove 18 formed on its periphery between supporting side rails 19. The groove 18 receives the depending tangs of the drive links of the saw chain and the supporting rails 19 support the bottom (bearing) surface of the side links of the saw chain. The guide bar 16 has internal ducts 20 with multiple spaced ports 22 leading to the guide groove 18 for conducting a flushing, lubricating and cooling fluid. An endless saw chain 30 is entrained around the guide bar 16 and the drive sprocket 14 and is propelled by the drive sprocket of the power head in a conventional manner. The drive sprocket 14 of the power head, as previously stated, is drivable in either direction and therefore the saw chain may be driven in either direction around the guide bar.

Figure 2:
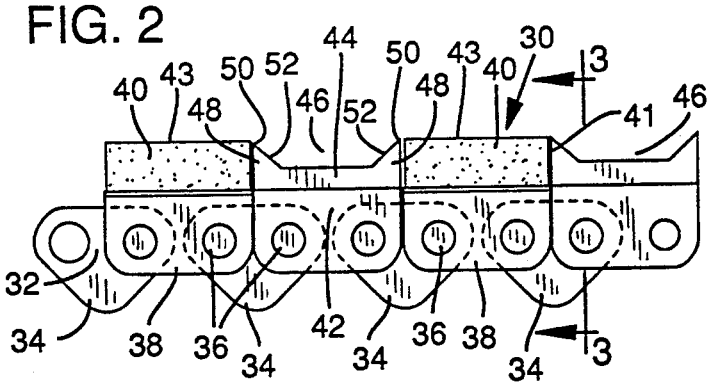
FIG. 2 is an enlarged partial view of the saw chain utilized on the chain saw of FIG. 1 showing one embodiment of the cutting blocks and cutting block guards.

FIG. 2 illustrates one embodiment of the endless saw chain 30. The saw chain is an articulated chain having center drive links 32 inter-connected by pairs of side links 38, 42. The interconnection of the links of the chain thus form a loop. The drive links 32 and the side link pairs ar suitably bored to be pivotally joined together by fasteners 36, such as rivets. The fasteners 36 are the pivotal axes of the links of the chain to provide the articulation necessary for the chain to traverse the guide bar and drive sprocket. The center drive links 32 of the saw chain 30 have depending tangs 34 that are engaged by the drive sprocket to propel the saw chain around the guide bar. The depending tangs also fit in the guide groove 18 of the guide bar to guide the saw chain as it is traverses around the guide bar.

The pairs of side-links that interconnect with the center drive links include a first pair of cutting block side-links 38 supporting a cutting block 40 and a succeeding pair of guard side-links 42 (non-cutting links) each having a guard portion 44 extending from the body portion for protecting the cutting blocks 40 against impacts. The pairs of cutting block side-links 38 and guard side-links 42 are alternately pivotally attached to the drive links 32 along the length of the saw chain 30. The cutter blocks 40 mounted to the body portions of the cutting block side-links 38 thus have a pair of guard side-links 42 at each end of the cutter block 40. The bottom surfaces of the body portions of the side link pairs 38, 42 are bearing surfaces that ride on the rails 19 of the guide bar 16 in frictional contact therewith in a conventional manner.

Figure 3:
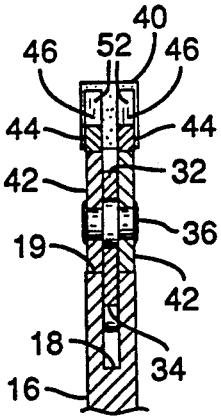
FIG. 3 is a sectional view as taken on view lines 3—3 of FIG. 2.

The cutting blocks 40 spa and are fixedly attached to the pair of cutting block side-links 38 as by welding. As shown in FIG. 3, the cutting block 40 extends across the width of the saw chain 30 and is of the same basic length as the cutting block side-link 38.

The guard portion 44 of the guard side-link 42 has a rate of wear that is at least equal to or greater than the wear rate of the cutting block 40. As the cutting block 40 is worn down, the guard portion 44 preferably wears sufficiently easy to minimize interference with the cutting action of the cutting block 40. It is preferable for the guard portion to be substantially of the same height as the cutting block although it is acceptable to have the guard portion within about 0.015 inch of the cutting block height.

One embodiment of a guard side-link 42 with guard portion 44 is illustrated in FIGS. 2 and 3. The guard side-link 42 with guard portions 44 are integrally formed. The guard portion 44 of the guard side-link 42 has at each of its ends a triangular section 48 that extends upwardly (as viewed in FIG. 2). A valley 46 formed between the sections 48 is devoid of material with an inclined edge 52 of each section 48 forming the sides of the valley 46. A tip 50 of the triangular end sections 48 is substantially at the same height as the cutting block 40 when the guard side-link 42 is assembled to the chain 30 (FIG. 2). With only the tips 50 of the end sections 48 at the same height as the cutting block 40, only a small surface area of the material of the guard portion 44 needs to be worn down as the cutting block 40 is worn away by the cutting action. The small surface area of the tips 50 exposed to the uncut aggregate thus increases the force per unit area applied to the tips 50 of the guard portion 44 during a cut and the wear rate is increased over that which would be experienced by a guard that is the full length of the guard side-link 42. The guard side-link 42 pair is assembled to the center drive links between successive cutting blocks 40 and therefore two sections 48 are provided adjacent each end of the cutting block 40. The inclined side 52 of each end section 48 provides an inclined plane (ramp) that will prevent the leading edge 41 of the cutting block 40 from impacting against an object that may be received in the valley 46. The inclined side 52 will ramp the chain over the object received in the valley 46 to prevent the leading edge 41 of the cutting block 40 from impacting the object.

Figure 4:
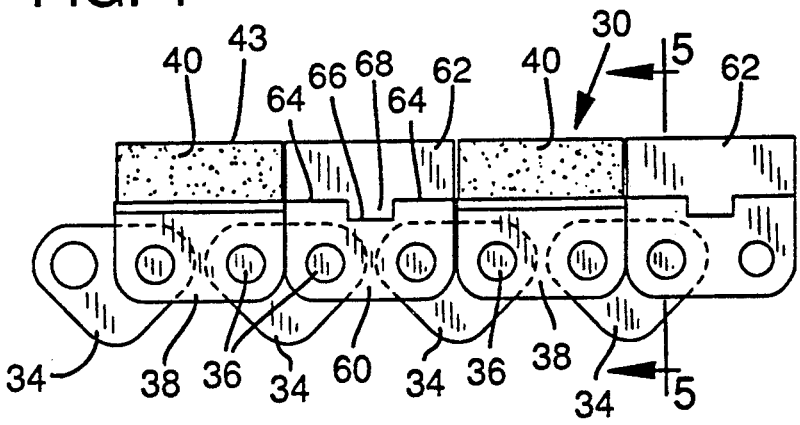
FIG. 4 is a view similar to FIG. 2 but illustrating a second embodiment of the invention.
Figure 5:
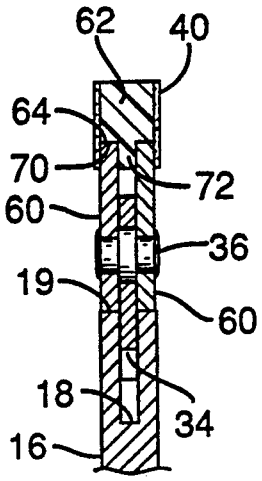
FIG. 5 is a sectional view as taken on view lines 5—5 of FIG. 4.
Figure 5A:
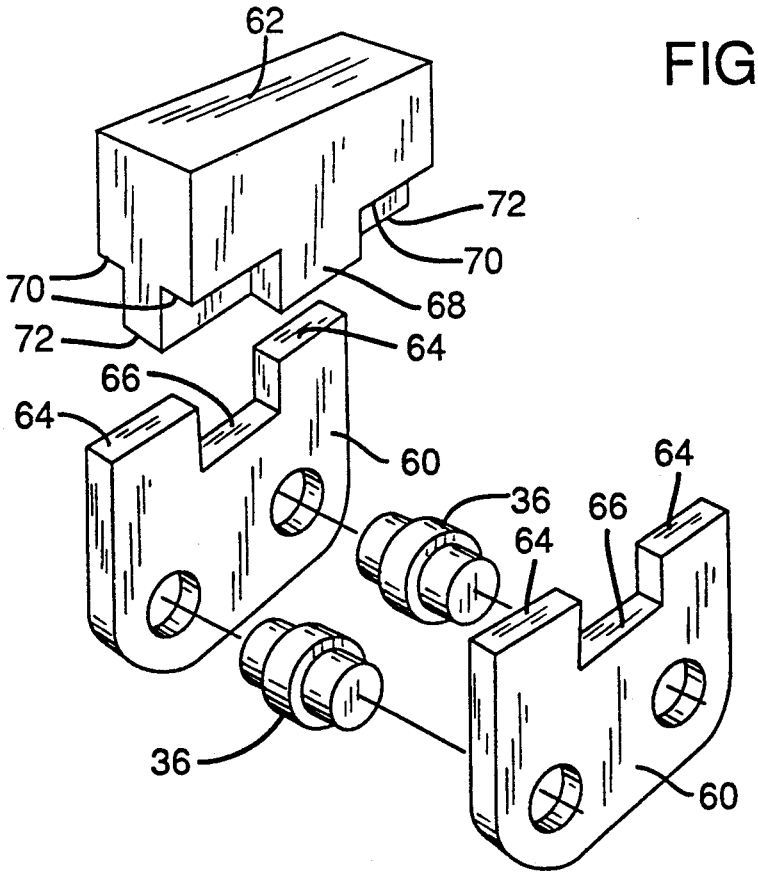
FIG. 5A is an enlarged exploded view of the guard side-link pair and guard of FIG. 4.

An alternate embodiment of a guard side-link pair with a guard portion is illustrated in FIGS. 4, 5 and 5A. The guard side-link 60 pair has a guard portion 62 preferably of a plastic material. The upper edge 64 of each guard side-link 60 has a notch 66 for receiving a tab 68 of the guard portion 62. The tab 68 is integrally formed on each side of the guard portion 62. The tab 68 and the notch 66 are dimensioned so that the tab 68 must be press fit into the notch 66. Shoulders 70 (FIG. 5A) extending from each tab 68 to each end of the guard portion are formed on each side of the guard portion 62. The shoulders 70 rest on the upper edges 64 of the guard side-links 60 upon assembly of the guard portion 62 to the pair of guard side-links 60. A projection 72 extending below the shoulder 70 fits tightly between the opposing guard side-links 60. The guard portion 62 is fitted to the pair of guard side-links 60 as by press fitting. The guard portion 62 extends from the guard side-link 60 pair to substantially the same height as the cutting block 40. Because the plastic material is substantially softer than the material of the cutting block 40 and side link 60, the guard portion 62 will readily wear down upon engaging the aggregate material and will not significantly interfere with the cutting action of the cutting block 40.

Figure 6:
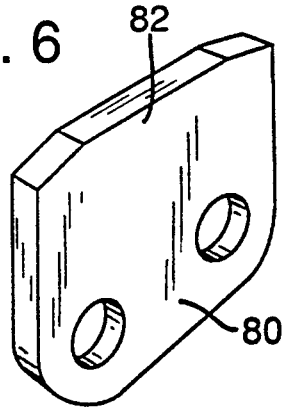
FIG. 6 is another embodiment of guard side-link with a guard portion.

FIG. 6 illustrates a guard side-link 80 having a guard portion 82 extending the full length of the guard side link. The guard side-link 80 and the guard portion 82 are of the same material however the guard portion 82 shown somewhat shaded is discriminately annealed to be softer that the lower body portion of the guard side-link 80. It is preferable to have the guard portion 82 in a hardness range on the order of 26 Rockwell C (less than 27 Rockwell C) and the lower body portion of the guard side-link 80 in a hardness range on the order of 51 Rockwell C (greater than 50 Rockwell C).

Figure 7:
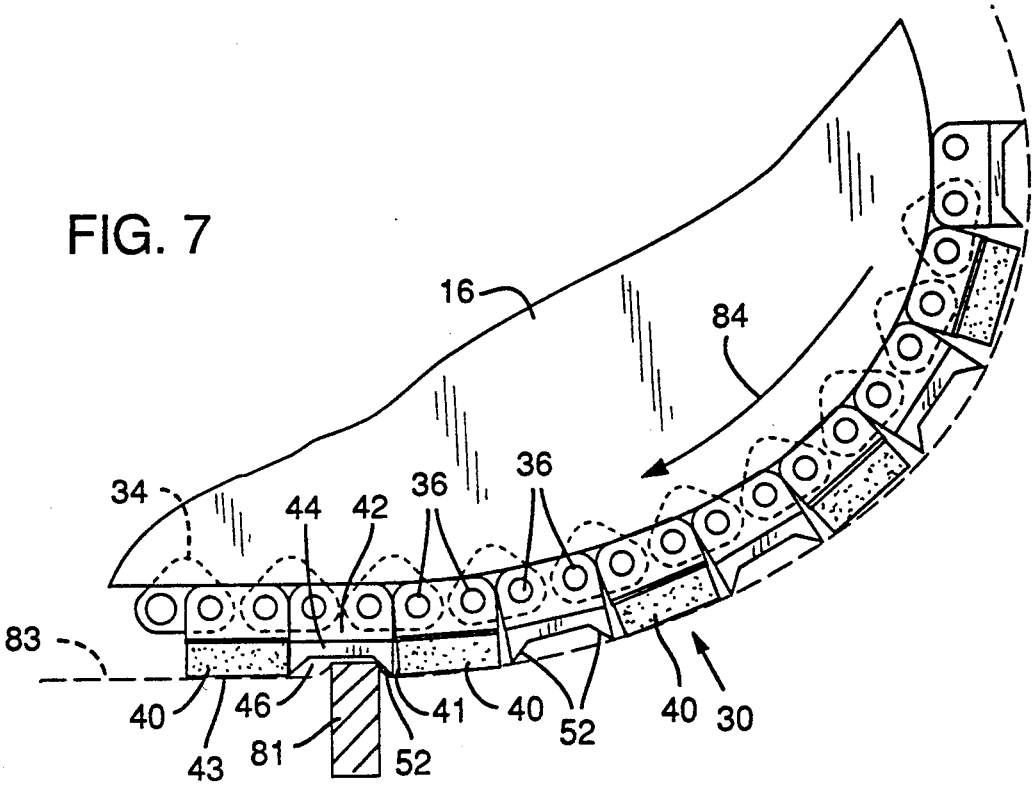
FIG. 7 is a partial view showing the chain saw producing a cut in a material.
Figure 8:
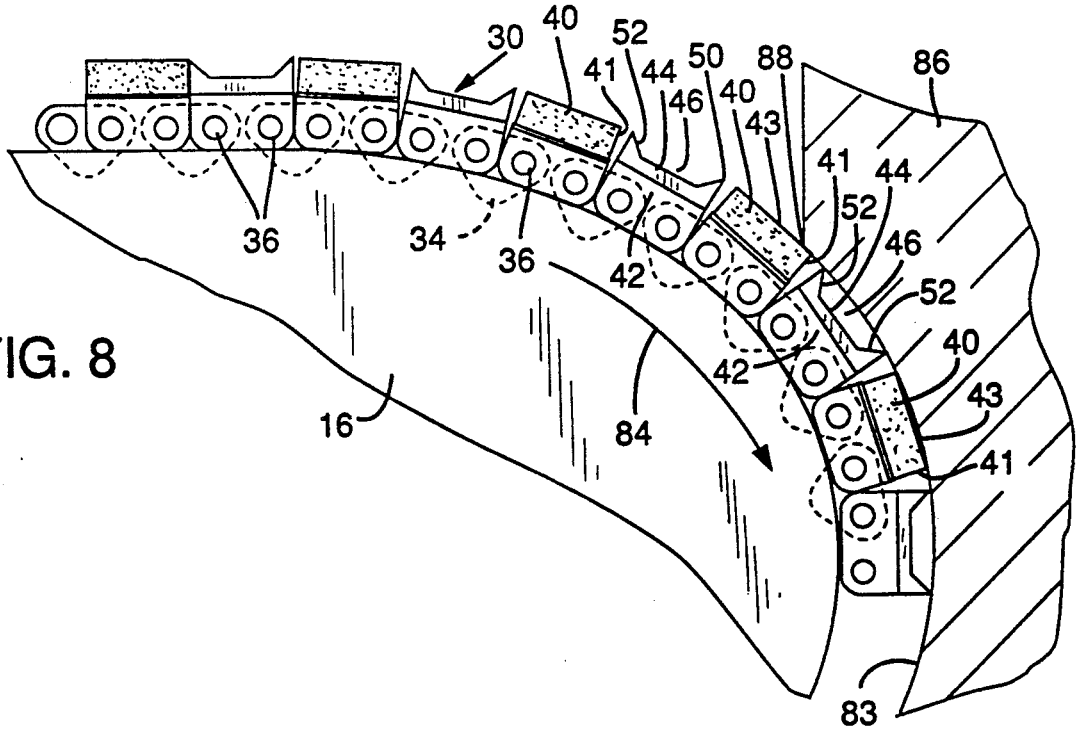
FIG. 8 is a partial view showing the chain in a plunge cut.

FIGS. 7 and 8 are illustrative of the saw chain in the process of producing a cut in a material, such as concrete. FIG. 7 shows an object 81 in the kerf projecting above the saw kerf base 83. The object 81, such as a hard stone or rebar, is received in the valley 46 of the guard portion 44. The inclined edge 52 will engage the object 80 as the chain progresses in the direction indicated by the directional arrow 84. The engagement of the inclined edge 52 will force the chain 30 to be ramped over the object 81 and thus prevent an impact as between the leading edge 41 of the cutting block 40 and the object 81. The cutting face 43 will however engage and abrade through the hard material consistent with the cutting action for which the cutting block is designed.

FIG. 8 illustrates a condition where a plunge cut is being produced by the chain saw by forcing the nose end of the guide bar into material 86. The saw chain is being propelled in the direction as indicated by directional arrow 84. As shown, the guard portion 44 which has the tip 50 substantially at the same height as the cutting block 40 prevents the leading edge 41 of the cutting block 40 from impacting against the edge 88 of the material 86. Again it is only the exposed surface (face) 43 of the cutting block that is permitted to engage the aggregate material.

Having disclosed several alternate embodiments of the invention, it is believed appropriate to review the various criteria that should be considered for achieving the full benefits of this invention.

Aggregate materials, as the term is used herein, includes those materials that are hard and brittle. Concrete, brick, granite, marble, sandstone, limestone and the like are all characterized herein as aggregate materials. Such materials are not severed but instead are abraded, i.e., by a sliding or rubbing action. The scraping or abrading is accomplished by a cutting block that typically includes an abrasive surface provided by industrial diamond chips imbedded into a matrix, e.g., of steel, cobalt or copper. Different grades of diamond, different sizes and/or different concentrations of the diamonds are employed depending on the aggregate material being cut.

The diamond chips act like tiny rigid spikes that protrude from the block surface to scrape and break down the aggregate into tiny particles referred to as aggregate dust. As the diamond chips wear away, so, too, does the matrix and new diamond chips are continuously exposed to maintain cutting efficiency of the block throughout its useful life.

The process of wearing of the cutting block is referred to herein as its "wear factor". The higher or greater the "wear factor", the faster the material wears away. Because of the variables involved, e.g., the type of aggregate material being cut, the type of material used as the matrix, and the grade, size and concentration of diamond chips, the "wear factor" for the cutting block is different from one cutting application to another.

The guard portion of the guard link has a wear factor that is also effected by variables in design and materials used. Because the guard portions need to be substantially the same height as the cutting block, the guard portions must wear away during the cutting operation at a rate at least as fast as the cutting block wears away, i.e., the wear factor of the guard portion must be at least as great as the wear factor of the cutting block. If the guard portion undesirably resists wearing, the cutting action will be inhibited.

On the other hand (as previously explained), the guard link has to resist wearing at the bearing surfaces, e.g., surrounding the rivets and at the bottom edges that slide along the guide bar rail. To produce the guard link in total from a soft material is to shorten the useful life of the chain. The wearing of the link will soon cause the guard link to break and the chain to come apart. It has thus been determined that the wear factor of the material of the guard portion (that portion that slides against the aggregate) cannot be established simply by using a softer material for the entire guard link.

"Wear factor" within the context of cutting aggregate materials can be affected by shape as well as material hardness. A guard portion that slides against the aggregate will wear away in relation to the surface area in contact with the aggregate. By reducing the surface area of the guard portion in contact with the aggregate material, e.g., to a point, the wear factor is increased. (Compare this to a wood cutting chain where a pointed guard link will penetrate into the wood and lose its ability to function as a guard link.)

With the above understanding, it follows that if the material of the guard link is to have a common hardness throughout, the wear factor of the guard portion must be increased by reducing the area of the guard position in contact with the aggregate. Conversely, if the guard portion is to have a greater surface area contact, e.g., as disclosed in U.S. Pat. No. 4,920,947, the guard portion as compared to the rest of the guard link must be a softer material, either by providing a guard portion attachment to the guard link that is of a softer material or by modifying the guard portion hardness in a discretionary heat treating process.

In any event, the final measure of acceptability is the relative wear factors, i.e., the rate of height reduction of the cutting block versus the guard portion when subjected to sliding or abrading contact with the aggregate.

Ideally, this relationship of wear factors would be generated with a formula setting forth the desired relationship of physical properties as between the type of aggregate materials being cut, the matrix and diamonds (size, grade and concentration) in the cutting block and the material of the guard portion (taking into consideration the surface area contact). However, no feasible formula can be devised and a far easier manner of making this determination is through a simple testing procedure as follows.

The cutting block is selected for its known capability of cutting a designated aggregate. A test portion of the aggregate is mounted in a test rig (referred to as a swath cut test rig). Saw chain equipped with the selected cutting blocks is mounted to the power head and the guide bar of the test rig and a known power and pressure is applied for cutting the test material. The power, pressure and rate of cut for the test is recorded. The proposed guard links are then added into the saw chain. If the power and cutting rate are relatively unchanged (within acceptable limits, e.g., five percent), the guard link is considered acceptable. Selecting the least expensive guard link believed to be acceptable and testing it first will generally establish the most preferred saw chain combination. Experience of the test operator will greatly reduce this trial and error selection process but in any event, with only a minimal amount of experimentation performed by a person skilled in the art, an acceptable, if not ideal, saw chain combination will be determined.

The embodiments disclosed herein are intended as examples of the invention and others skilled in the art will likely conceive of alternative designs that are nevertheless encompassed by the invention. The invention is determined in accordance with the claims appended hereto.

What is claimed is:

1. A saw chain adapted to be driven in a circuitous path around a guide bar for cutting aggregate material comprising:

pivotally interconnected links forming a sequence of links having bearing surfaces at the areas of pivotal interconnection and at areas where the saw chain is supported on the guide bar, abrasive cutting blocks mounted on certain of said links and forming cutting links, non-cutting links separating said cutting links, and a guard portion provided on one of said non-cutting links between the cutting links, said abrasive cutting blocks extended to a common height and said guard portions co-extended to substantially the same height for protecting the leading edge of a following abrasive cutting block when driven around the guide bar;

said guard portion on said one of said non-cutting links configured in side view so as to converge to a peak that is positioned immediately preceding the abrasive cutting block, said abrasive cutting block and guard portions having wear factors determined by the rate of height reduction resulting from abrading contact with an aggregate material being cut, and said guard portions having a wear factor that is at least as great as the wear factor of the cutting block.

2. A saw chain adapted to be driven in a circuitous path around a guide bar for cutting aggregate material comprising:

pivotally interconnected links forming a sequence of links having bearing surfaces at the areas of pivotal interconnection and at areas where the saw chain is supported on the guide bar, abrasive cutting blocks mounted on certain of said links and forming cutting links, non-cutting links separating said cutting links, and a guard portion provided on one of said non-cutting links between the cutting links, said abrasive cutting blocks extended to a common height and said guard portions co-extended to substantially the same height for protecting the leading edge of a following abrasive cutting block when driven around the guide bar;

said guard portions provided at the trailing end of the non-cutting links immediately preceding the cutting link and narrowed at the point of contact with the aggregate material to generate the desired wear factor of the guard portion while maintaining the desired hardness and resistance to wearing at the bearing surfaces.

3. A saw chain as defined in claim 2 wherein the guard portions are provided at both trailing and leading ends of the non-cutting side links to provide a guard portion immediately preceding the cutting links when driven in either circuitous direction.

4. A saw chain adapted to be driven in a circuitous path around a guide bar for cutting aggregate material comprising:

pivotally interconnected links forming a sequence of links having bearing surfaces at the areas of pivotal interconnections and at areas where the saw chain is supported on the guide bar, abrasive cutting blocks mounted on certain of said links and forming cutting links, non-cutting links separating said cutting links, and a guard portion provided on one of said non-cutting links between the cutting links, said abrasive cutting blocks extended to a common height and said guard portions co-extended to substantially the same height for protecting the leading edge of a following abrasive cutting block when driven around the guide bar;

said abrasive cutting block and guard portions having wear factors determined by the rate of height reduction resulting from abrading contact with an aggregate material being cut, and said guard portions having a wear factor that is at least as great as the wear factor of the abrasive cutting block;

said guard portion provided with a different hardness property than the portion providing the bearing surfaces whereby the guard portions have the desired wear factor and the bearing surfaces have the desired wear resistance.

5. A saw chain as defined in claim 4 wherein the different hardness property is produced by discretionary heat treatment of the guard portion.

6. A saw chain as defined in claim 4 wherein the non-cutting link has a body portion providing the bearing surfaces, said guard portion provided by a material different than the body portion, the material of the body portion being harder and more wear resistant than the material of the guard portion, and attachment means for attaching the guard portion to the body portion.

7. A saw chain as defined in claim 6 wherein said different material is a plastic.

8. A saw chain as defined in claim 1 wherein the guard portion is within 0.015 inch of the height of said abrasive cutting block.

* * * * *